US007008277B2

(12) United States Patent
Caulfield

(10) Patent No.: US 7,008,277 B2
(45) Date of Patent: Mar. 7, 2006

(54) CUTTING APPARATUS

(75) Inventor: Richard Hammerton Caulfield, Banjup, WA (US)

(73) Assignee: Environmental Separation Technologies Pty. Ltd., Bibra Lake (AU)

( * ) Notice: Subject to any disclaimer, the term of this patent is extended or adjusted under 35 U.S.C. 154(b) by 0 days.

(21) Appl. No.: 10/360,742

(22) Filed: Feb. 10, 2003

(65) Prior Publication Data

US 2003/0124921 A1 Jul. 3, 2003

Related U.S. Application Data

(63) Continuation-in-part of application No. PCT/AU01/00986, filed on Aug. 10, 2001.

(30) Foreign Application Priority Data

Aug. 10, 2000 (AU) ..... PQ9333
Nov. 22, 2002 (AU) ..... 2002952814

(51) Int. Cl.
*B63H 1/28* (2006.01)

(52) U.S. Cl. ..... 440/73

(58) Field of Classification Search ..... 440/73; 416/146 R; 30/478
See application file for complete search history.

(56) References Cited

U.S. PATENT DOCUMENTS

| | | | | |
|---|---|---|---|---|
| 1,813,540 A | | 7/1931 | Laska | |
| 2,701,416 A | * | 2/1955 | Snyder | 30/293 |
| 4,180,368 A | * | 12/1979 | Henrich et al. | 416/146 R |
| 4,450,670 A | | 5/1984 | Robinson | |
| 4,722,667 A | | 2/1988 | Rikhy et al. | |
| 4,801,281 A | | 1/1989 | Govan | |
| 5,052,957 A | | 10/1991 | Govan | |
| 5,807,150 A | * | 9/1998 | Minter, Sr. | 440/73 |
| 6,113,445 A | * | 9/2000 | Trosclair | 440/73 |

FOREIGN PATENT DOCUMENTS

| | | |
|---|---|---|
| GB | 2028243 | 3/1980 |
| WO | WO 00/56420 A1 | 9/2000 |
| WO | WO 01/92103 A1 | 12/2001 |
| WO | WO 02/14146 A1 * | 2/2002 |

* cited by examiner

*Primary Examiner*—Sherman Basinger
(74) *Attorney, Agent, or Firm*—Edell Shapiro & Finnan

(57) ABSTRACT

A cutting apparatus for cutting debris from a propeller including a spool fixed to a propeller shaft so as to rotate with the propeller shaft and a cutter oriented to cut the debris from the spool. In use, debris snagged by the propeller is wound onto the spool, whereupon it is cut away by the cutter.

12 Claims, 9 Drawing Sheets

CUTTING APPARATUS

CROSS REFERENCE TO RELATED APPLICATIONS

This application is a continuation-in-part of International Application No. PCT/AU01/00986, entitled "A Cutter for Debris Removal From a Propeller", and filed Aug. 10, 2001, which was published in English under PCT Article 21(2). The disclosure in the above-referenced patent application is incorporated herein by reference in its entirety.

FIELD OF THE INVENTION

The present invention relates to a cutting apparatus for cutting debris from a propeller. In particular, a marine vessel propeller.

BACKGROUND OF THE INVENTION

Marine vessels, and in particular fishing vessels and crayfish boats often travel in water that contains rope and long-line fishing line. When the vessel passes over the rope or fishing line it will often become snagged around the spinning blades of the propeller, which, due to the spinning action, causes the rope, fishing line or other debris to become wound around the propeller shaft. As the debris is wound in, it builds up between the propeller and a bearing through which the propeller shaft rotates. Friction caused by the build up of rope can be created to the point where the debris, being made of plastics, can often melt and fill lubricating grooves of the bearing. This can prevent the flow of lubricating fluid through the bearing, which can cause the bearing to seize. Pressure due to the build up of debris pushes the propeller away from the bearing, which can damage the drive train that rotates the propeller shaft.

Some attempts have been made to arrange blades close to the propeller to attempt to cut away rope and other debris. Some of these blades are arranged to project laterally of the bearing thus attempting to cut rope as it is wound in. Other blades are arranged to point into a gap between a forward boss of the propeller and the bearing. In some instances, the bearing has been filled with a free wheeling collar member that attempts to fill this gap. The collar member is allowed to freely rotate about the propeller shaft so as to not block the lubricating grooves of the bearing. Sometimes the collar member includes holes that allow water to run therethrough.

Currently used blades have had limited success. However, they quite often result in a mass of tightly compacted debris that is beyond the reach of the blade and that can still cause damage.

SUMMARY OF THE PRESENT INVENTION

The present invention seeks to provide a new cutting apparatus that is more effective in cutting debris from the propeller.

According to the present invention there is provided a cutting apparatus for cutting debris from a propeller including:

a spool means fixed to a propeller shaft so as to rotate with the propeller shaft;

a cutter oriented to cut the debris from the spool means;

whereby in use, debris snagged by the propeller is wound onto the spool means, whereupon it is cut away by the cutter.

Preferably, the spool means is disposed between the propeller and a bearing holding the propeller shaft.

Preferably, the cutter has a cutting edge oriented to cut the build up of debris moving towards the bearing. Preferably, the cutter is arranged to be closely positioned to the spool means so that the cutter glides over a circumferential surface of the spool means. Preferably, the spool means is substantially cylindrical.

Preferably, the cutter is one of a plurality of cutters.

Preferably, the cutting edge is oriented to cut into debris accumulating or moving generally longitudinally of the propeller shaft towards the bearing.

Preferably, the position of the cutter is adjustable. Preferably, the cutter is attached to a carrier of the bearing. Preferably, the cutter overlaps the spool means. Preferably, the cutter overlaps a liquid outlet of the spool means. Preferably, the spool means is a centrifugal pump.

Preferably, the cutting edge is one of a plurality of cutting edges, each cutting edge oriented to cut debris for one of the respective directions of rotation of the propeller. Preferably, the cutter faces the propeller.

Also according to the present invention, there is provided a cutting apparatus for cutting debris from a propeller comprising:

a spool means fixed to a propeller shaft or the propeller so as to rotate with the propeller shaft and the propeller;

a cutter oriented to cut debris that accumulates on the spool means;

wherein the spool means is in the form of a liner ring mounted on a circumferential surface of a boss of the propeller;

whereby in use, debris snagged by the propeller is wound onto and accumulates on the spool means, whereupon debris is cut away by the cutter.

According to another aspect of the present invention, there is provided a cutting apparatus for cutting debris from a propeller comprising:

a spool means fixed to a propeller shaft or the propeller so as to rotate with the propeller shaft and the propeller;

a cutter oriented to cut debris that accumulates on the spool means;

wherein the cutter is coupled to a leg of an outboard motor;

whereby in use, debris snagged by the propeller is wound onto and accumulates on the spool means, whereupon debris is cut away by the cutter.

In accordance with another aspect of the present invention, there is provided a cutting apparatus for cutting debris from a propeller comprising:

a spool means fixed to a propeller shaft or the propeller so as to rotate with the propeller shaft and the propeller;

a cutter oriented to cut debris that accumulates on the spool means;

wherein a portion of the cutting edge of the blade is disposed at an acute angle to a surface of the spool over which the cutter skims.

According to yet another aspect of the present invention, there is provided a cutting apparatus for removing debris from a propeller comprising:

a spool means arranged to accumulate debris and rotate with the propeller;

a cutter oriented to cut debris that accumulates on the spool means, the cutter overlapping with a portion of the propeller;

wherein the spool means includes a sacrificially wearable element positioned between the cutter and the propeller.

Preferably the spool means has a flange for fitting within a recess or groove in a boss of the propeller. More preferably the recess is formed at a shoulder of the boss of the propeller. Preferably the spool means is fixed to the propeller by an interlocking overlap between an inwardly directed flange of the spool and the recess or groove of the propeller.

Preferably the cutter is coupled to a skeg of a leg of an outboard motor.

Preferably the spool means is in the form of a disc located between the boss of the propeller and a bearing through which passes the propeller shaft. The disc may overlap a portion of the boss of the propeller.

Preferably the spool means protects the propeller in a sacrificial manner from wear by or contact with the cutter.

Preferably the spool means is a single piece annulus. Alternatively the spool means is formed of a plurality of pieces that together form an annulus shaped spool.

Also according to the present invention, there is provided a propeller comprising a spool means arranged to accumulate debris with rotation of the propeller for cutting away by a cutter oriented to cut debris accumulated on the spool means.

In accordance with another aspect of the present invention, there is provided a spool for coupling to a propeller shaft or propeller so as to rotate with the propeller shaft and the propeller, the spool arranged to accumulate debris, in use, for cutting away by a cutter oriented to cut debris that accumulates on the spool.

In accordance with another aspect of the present invention, there is provided a cutter for cutting debris from a propeller comprising a cutting edge, in use oriented to cut debris that accumulates on a spool means fixed to a propeller shaft or propeller so as to rotate with a propeller shaft and propeller, whereby debris snagged by the propeller is wound onto and accumulates on the spool means whereupon the debris is cut away by the cutter.

Throughout this specification the term "outboard motor" is intended to mean a true outboard motor or other types of outboard motor commonly referred to as "stem drive outboard", "Z-drive" or "inboard/outboard" motor.

Furthermore, although the term "outboard motor" is used, the relevant feature is a movable or removable drive mechanism and propeller.

DETAILED DESCRIPTION OF PREFERRED EMBODIMENTS

In order to provide a better understanding of the present invention, preferred embodiments will now be described in detail, by way of example only, with reference to the accompanying drawings.

Figure 14A:
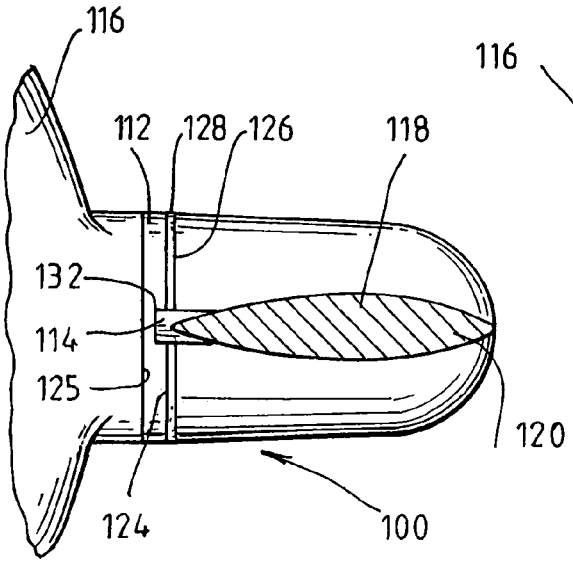
FIG. 14A is a cross-sectional plan view of an alternative embodiment of a cutting apparatus in accordance with the present invention.
Figure 15A:
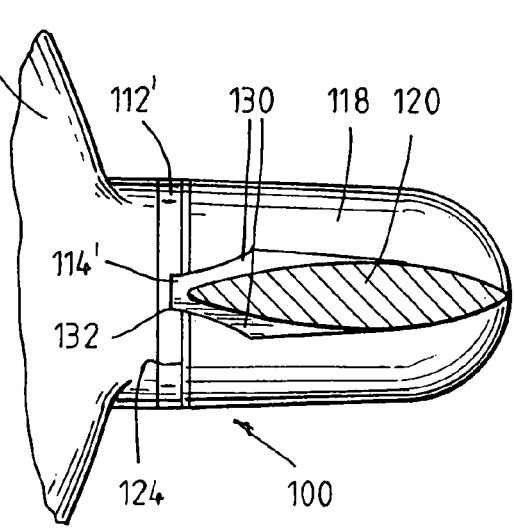
FIG. 15A is a cross-sectional plan view of another alternative embodiment of a cutting apparatus in accordance with the present invention.
Figure 15B:
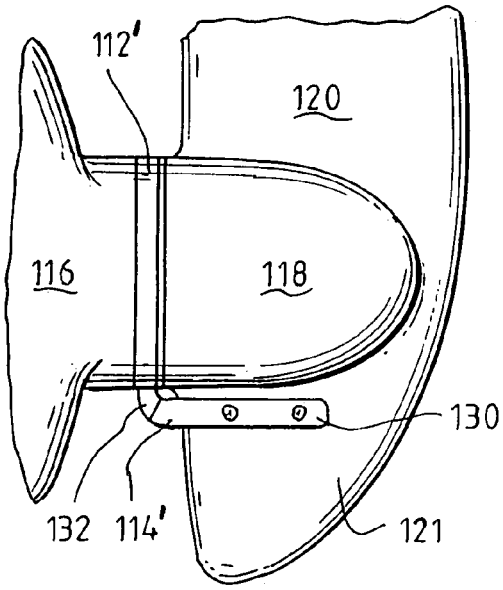
FIG. 15B is a side view of the cutting apparatus of FIG. 15A.
Figure 16:
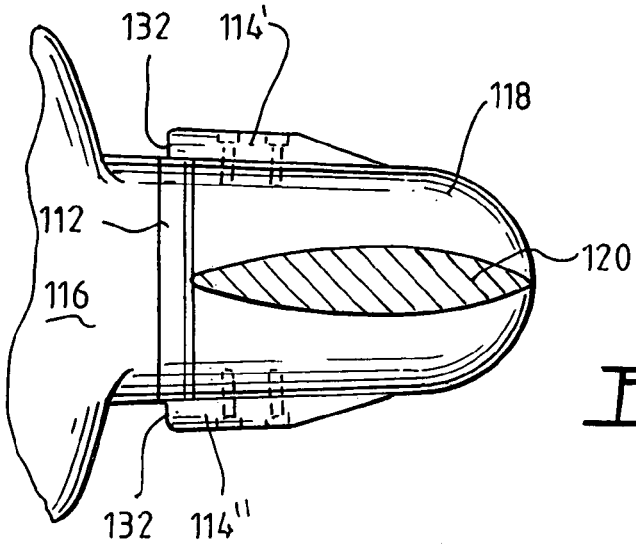
FIG. 16 is a cross-sectional plan view of yet another alternative embodiment of a cutting apparatus in accordance with the present invention.
Figure 17:
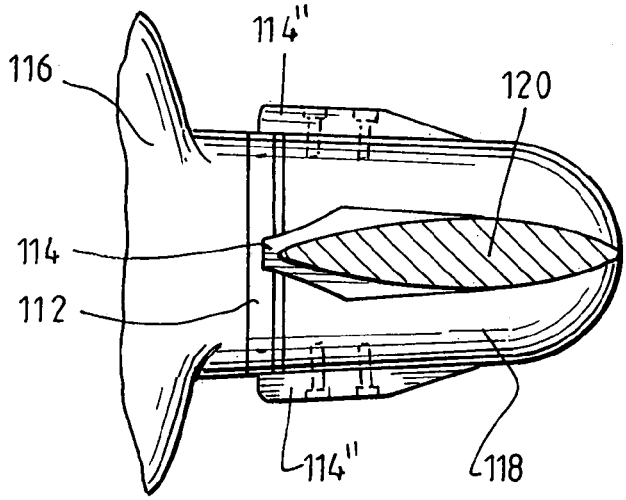
FIG. 17 is a cross-sectional plan view of cutting apparatus of FIGS. 15A and 16.
Figure 20:
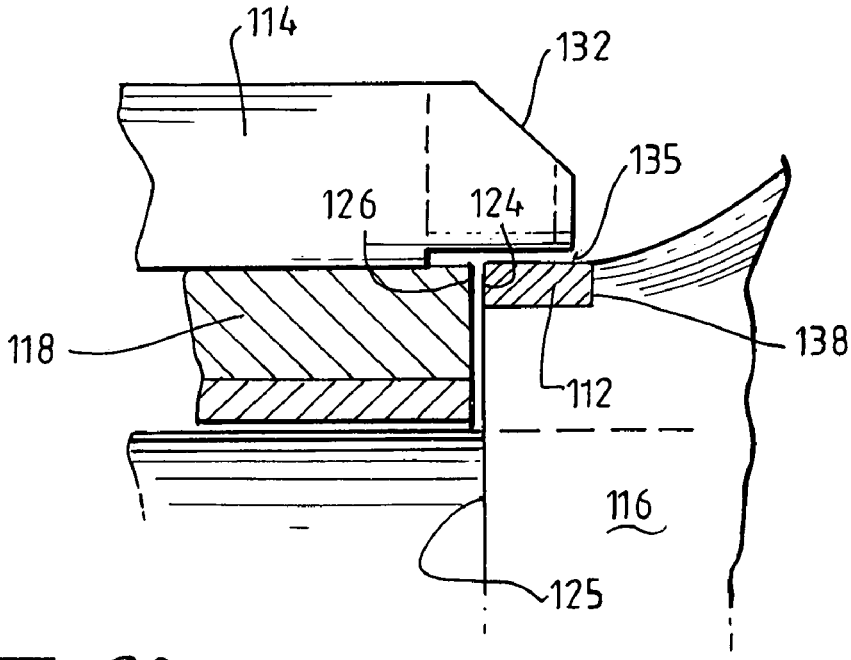
Figure 21:
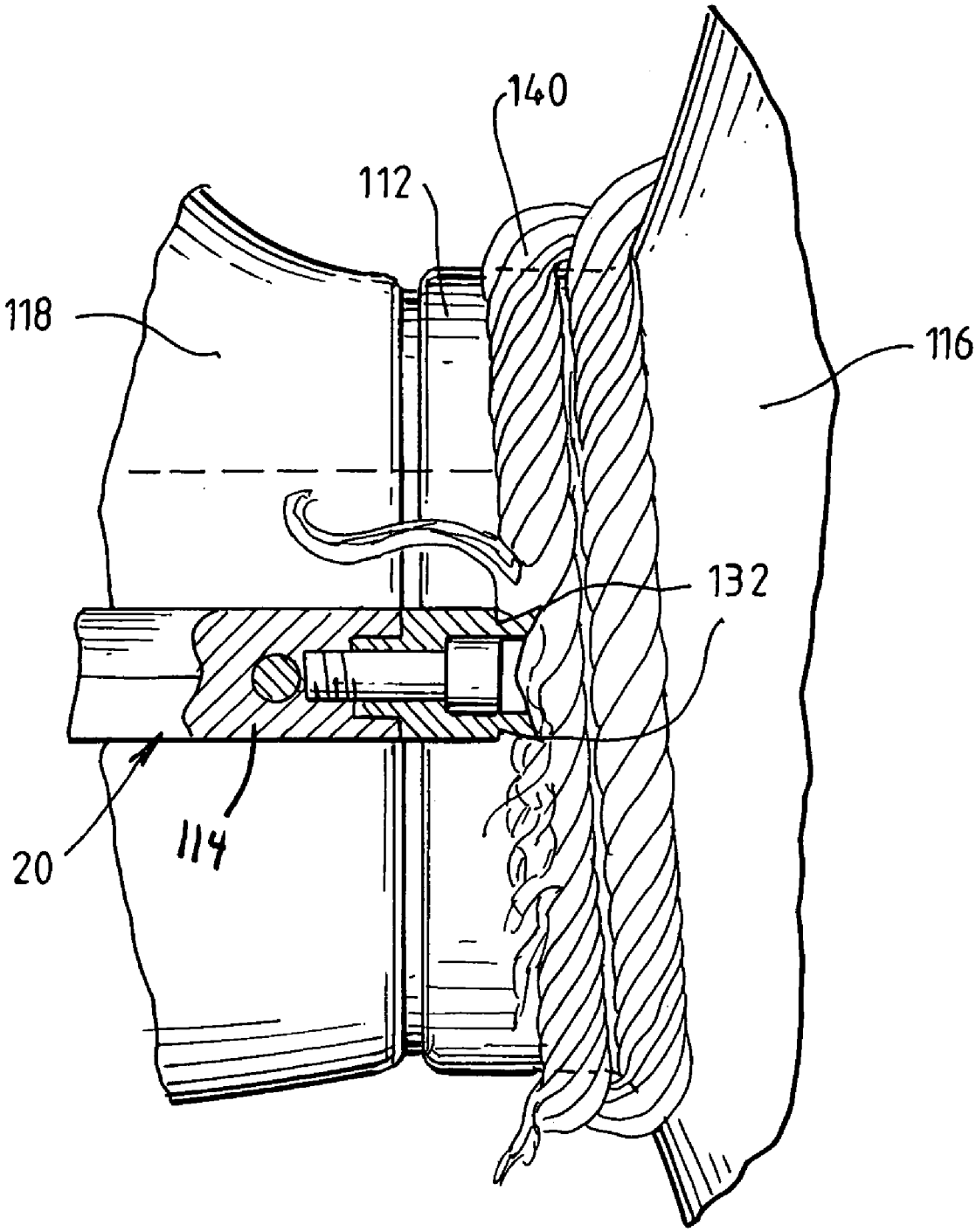

FIG. 20 in a side elevation of yet another alternative embodiment of a spool in accordance with the present invention; and FIG. 21 is a close up plan view of the cutting apparatus of FIGS. 14A, 15A or 16 in use.

Figure 1:
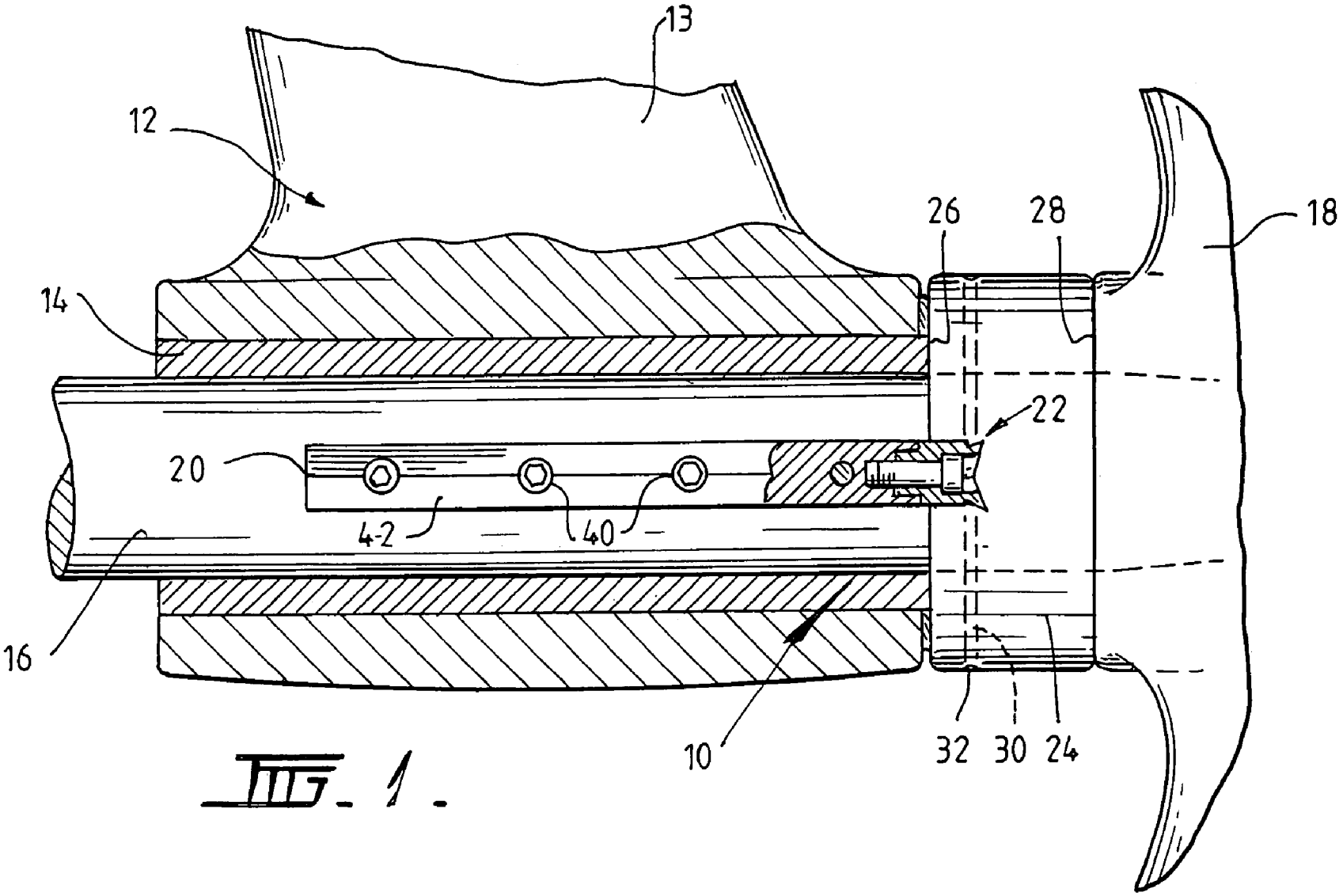
FIG. 1 is a cross-sectional side view of an "inboard motor" propeller shaft housing carrying a preferred embodiment of a cutting apparatus in accordance with the present invention.

Referring to FIG. 1, there is shown an inboard motor propeller assembly including a carrier 12 for carrying a bearing 14. The carrier 12 is normally situated under the hull of a marine vessel by a mounting member 13. A propeller shaft 16 passes through the bearing 14 to rotate a propeller 18. A cutting apparatus 10, fixed to the carrier 12, includes a laterally mounting portion 20 and a blade portion or cutter 22. The cutter 22 faces the propeller 18. A spool 24 is located between the bearing 14 and a boss 28 of the propeller 18. The cutter 22 overlaps with the spool 24 so that debris is removed from an end of the bearing 14 closest to the propeller 18. The spool 24 is fixed to the propeller shaft 16 so that it rotates with the propeller 18. The cutting apparatus 10 is fixed to the carrier 12 so that it remains stationary. In use, the propeller 18 and the spool 24 rotate about the propeller shaft 16 and will therefore be moving relative to the cutting apparatus 10.

Figure 2:
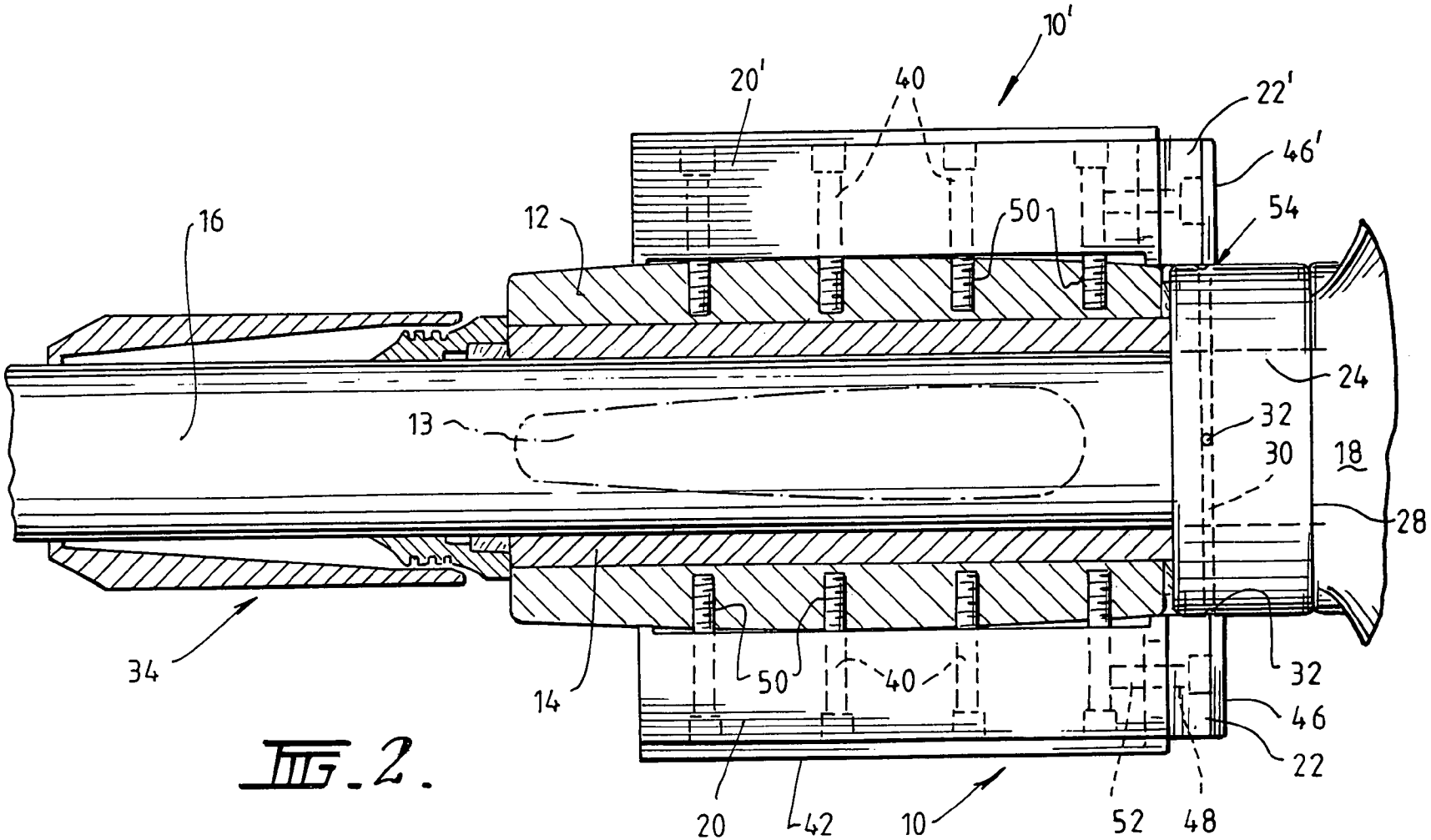
FIG. 2 is an upper perspective view of a pair of cutters fixed to a propeller shaft carrier including a cutter of the cutting apparatus of FIG. 1.

Referring to FIG. 2, a pair of cutters of apparatus 10 and 10' are fixed to and laterally project from either side of the carrier 12. In front of the bearing 14 and carrier 12 is a separator 34 as described in International Patent Application No. PCT/AU00/00248. The spool 24 may be a centrifugal pump as described in International Patent Application No. PCT/AU01/00632. In this case, channels 30 are provided in the pump to allow liquid through lubricating grooves in the bearing 14 to exit via the channels 30 at outlets 32 for each channel 30. The cutters 22 and 22' overlap with the outlets 32 to clear debris from the outlets 32.

The carrier 12 includes a plurality of threaded holes 50 which are positioned so as to align with holes 40 in each mounting portion 20. A threaded bolt passes the holes 40 and screws into the threaded holes 50 so as to secure the mounting portion 20 to the carrier 12.

Figure 7:
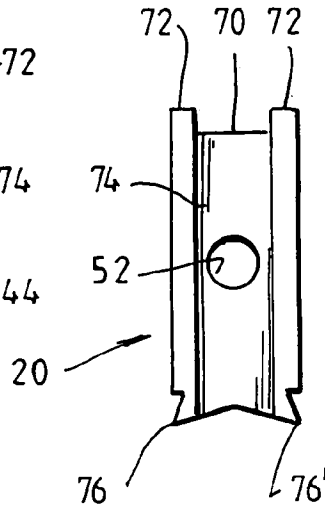
FIG. 7 is a plan view of a cutter of the cutting apparatus of FIG. 1.

As best seen in FIG. 7, oppositely facing blade edges 76 and 76' are located at the outer most lateral edge 42 of the mounting portion 20. The cutting edges 76 and 76' run longitudinally along the edge 42.

The mounting portion 20 includes a threaded hole 52 at a rear end 44 (closest to the propeller). The threaded hole 52 is for receiving another bolt that secures the cutter 22 to the mounting portion 20. A hole 48 passes through the cutter 22 for a bolt to pass through. The cutter 22 includes a pair of cutting edges 46 and 46' that face the propeller 18. The cutter 22 also has another pair of cutting edges 45 and 45' that are parallel with the cutting edges 76 and 76'.

Figure 3:
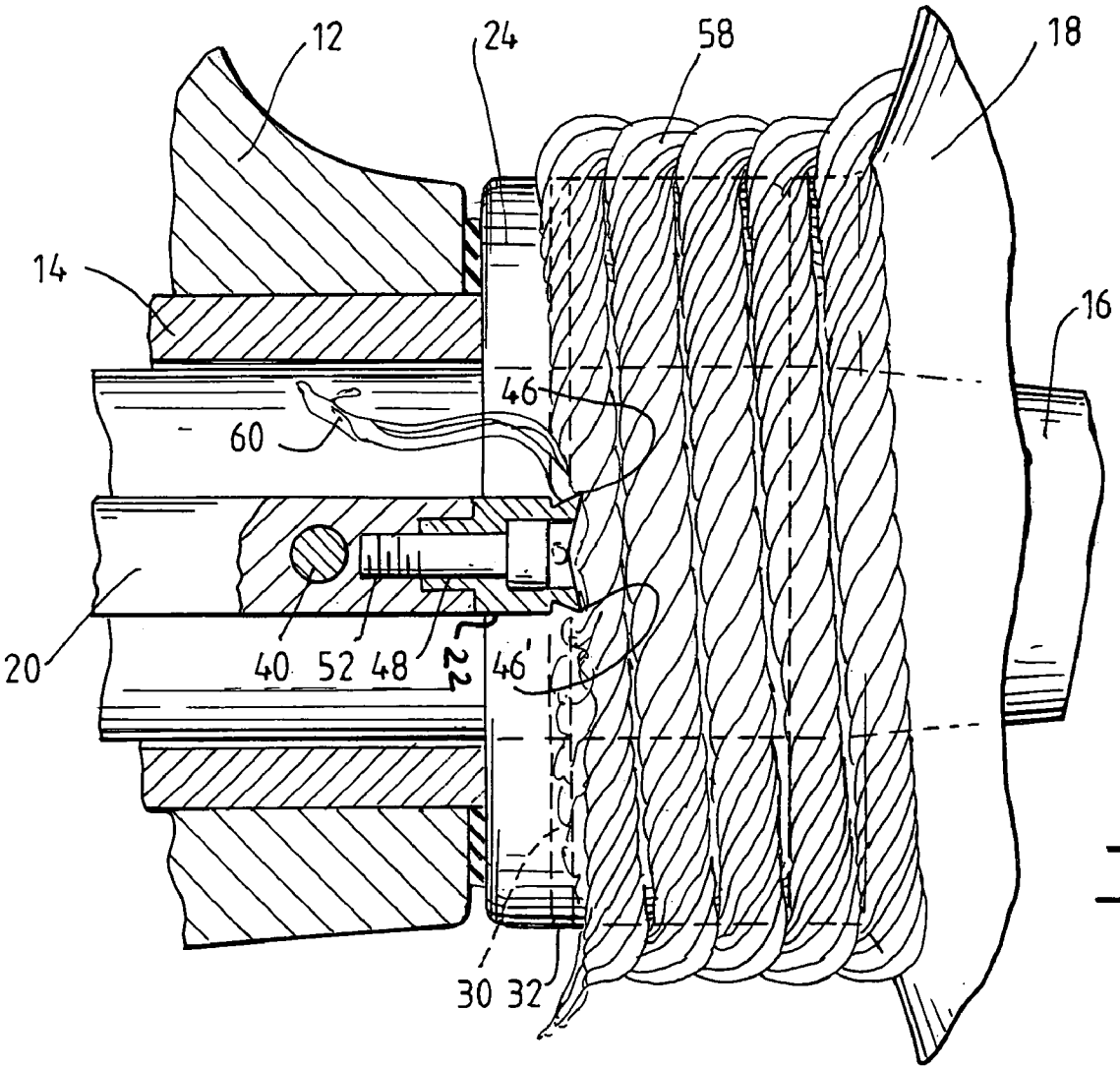
FIG. 3 is a close-up side view of the cutting apparatus of FIG. 1 in use cutting rope from the propeller.

Referring to FIG. 3, debris in this case rope 58, is shown snagged around the propeller 18, which has then been wrapped around the rear end of the propeller and then around the spool 24 due to the rotation of the propeller shaft 16. It can be seen that as the propeller shaft 16 continues to rotate the rope will build up in a direction moving away from the propeller 18, towards the bearing 14. As it moves closer to the bearing 14 it will eventually make contact with the cutting edges 46 or 46' of the cutter 22. This results in the rope being shaved off, as indicated by strand 60. The more it builds up, the more it moves towards the cutter and is cut away. Eventually the shaving of the rope will progress all the way through the width of the rope, or more likely, will cause the rope to be sufficiently weakened that it breaks.

If the marine vessel is travelling in reverse and the propeller shaft 16 will rotate in the opposite direction. The cutting edge 46' will be facing in a direction to cut debris from the spool 24 in the same manner as the cutting edge 46.

Figure 4:
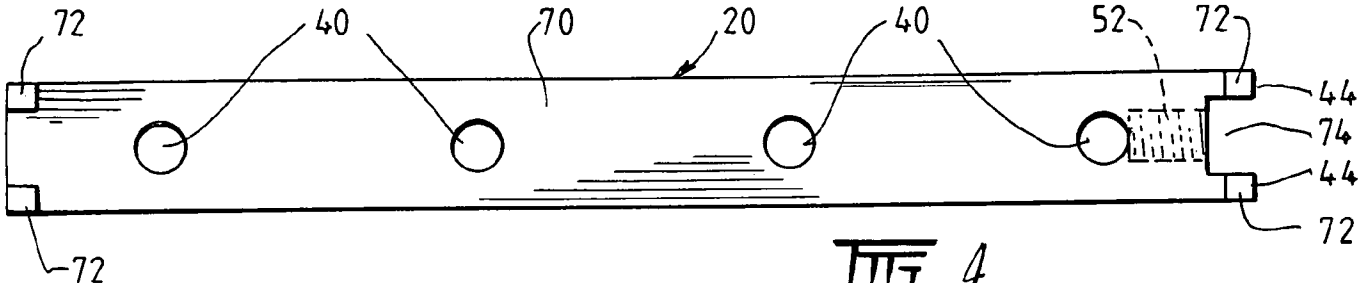
FIG. 4 is a bottom plan view of a mounting portion of the cutting apparatus of FIG. 1.
Figure 5:
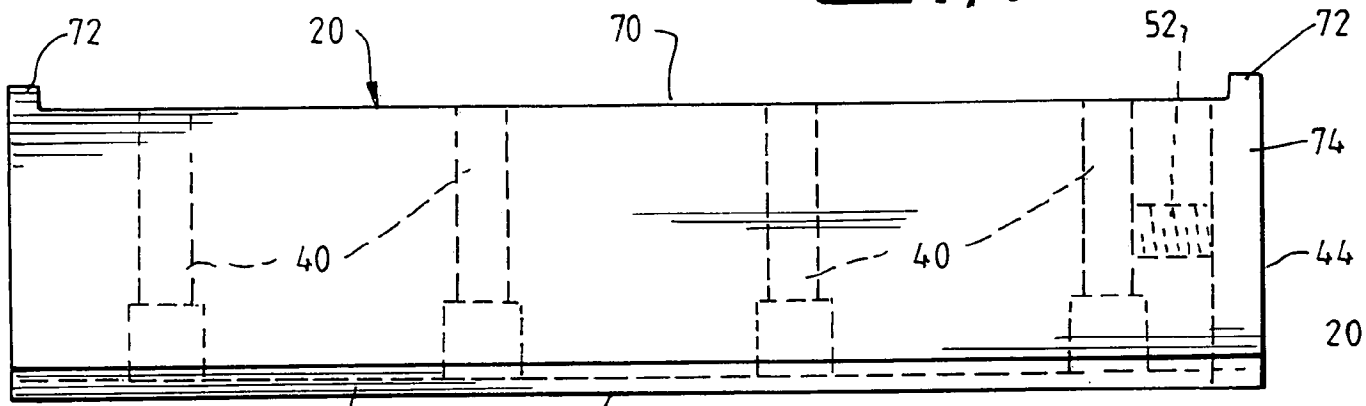
FIG. 5 is a side plan view of the mounting portion of FIG. 4.
Figure 6:
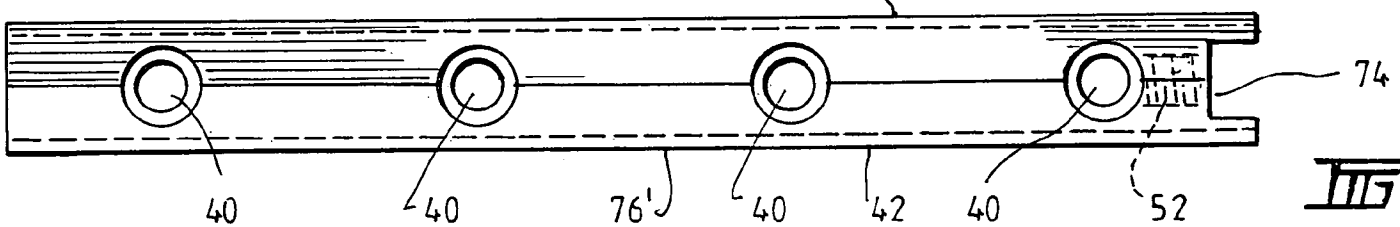
FIG. 6 is a top view of the mounting portion of FIG. 4.

Referring to FIGS. 4, 5 and 6, a surface 70 of the mounting portion 20 is shown. At each corner of the bottom surface 70 is a short leg 72. The legs 72 are provided so that a curve of the carrier 12 can be accommodated along the length of the bottom surface 70 and the mounting portion 20 secured firmly to the carrier 12. At the end 44 there is a slot 74. Leading inwardly from the slot 74 is the threaded hole 52.

Referring to FIG. 7, the lateral edge 42 of the mounting portion 20 is shown with the upper cutting edge 76 and the lower cutting edge 76'. These cutting edges will remove where debris being wrapping around not only the propeller 18 but the entire carrier 12.

Referring to FIGS. 8, 9, 10 and 11, the cutter 22 has a lower projection 80 that is received within the slot 74 of the mounting portion 20. This allows the cutter 22 to slide within the slot 74 laterally with respect to the propeller shaft 16. The projection 80 includes a notch 82 at the base 83, which slides over the circumferential surface of the spool 24. An elongated hole 48 allows the cutter 22 to move while the bolt for securing the cutter 22 to the mounting portion 20 is in place, but not tightened. This movement allows the cutter 22 to be adjusted in its height from the spool 24. The cutter 22 is adjusted so that the base 83 almost touches or lightly touches the spool 24. The bolt is tightened to secure it in position. The cutter 22 then glides or skims over the surface of the spool 24.

Referring back to FIG. 2, the clearance between the base 83 of the cutter 22 and the spool 24, as indicated by 54, is very small to negligible. In the drawing, the two appear to be touching. In practice, they may be just touching and after a few revolutions of the spool 24 the cutter 22 will become properly seated so that the moving surface of the spool 24 glides underneath the relatively stationary undersurface of the cutter 22. The gap between the two is required to be very narrow so that debris does not enter the gap 54 between the two. Yet, the gap must be sufficiently wide so that the two surfaces may glide in relation to each other. It is undesirable for the cutter 22 to gouge into the spool 24.

Figure 12:
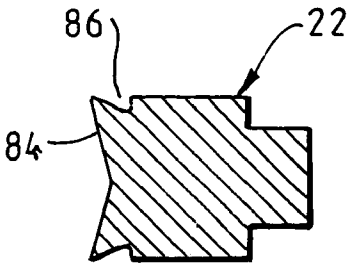
FIG. 12 is a cross-sectional side view of an alternative cutter to that shown in FIG. 10.
Figure 13:
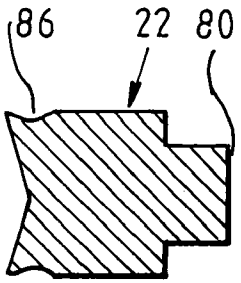
FIG. 13 is a cross-sectional side view of an another cutter to that shown in FIG. 10.
Figure 10:
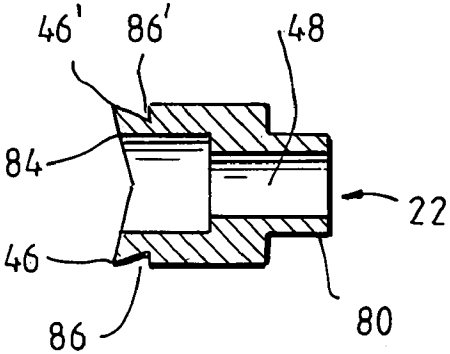
FIG. 10 is a cross-sectional side view of the cutter of FIG. 7.
Figure 8:
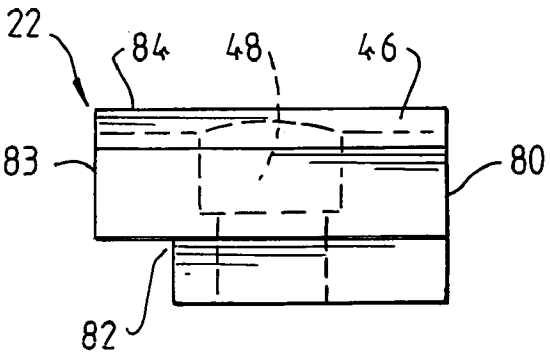
FIG. 8 is a side view of the cutter of FIG. 7.
Figure 11:
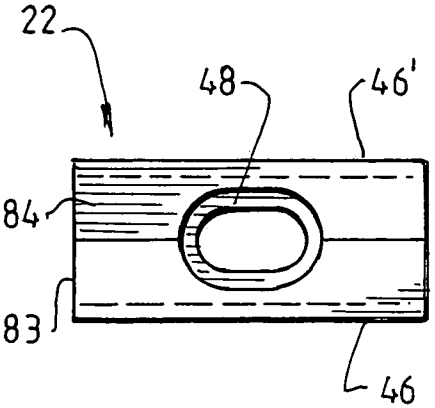
FIG. 11 is a rear view of the cutter of FIG. 7.
Figure 9:
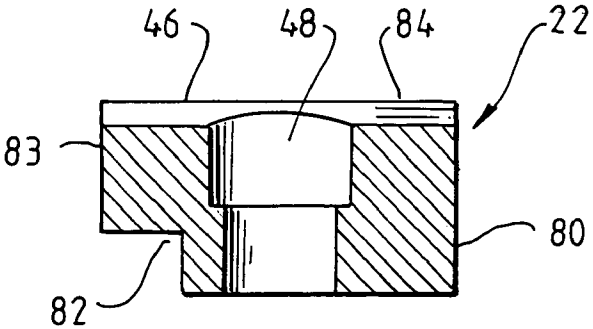
FIG. 9 is a cross-sectional side view of the cutter of FIG. 8.

Referring to FIGS. 10, 12 and 13, the cutting edge 46 is formed by an acute angle between an outer surface and a notch 86. FIG. 10 shows an inner edge of the notch being perpendicular to the outer edge of the cutter 22. FIG. 12 shows the inner edge of the notch being at an angle greater than 90° in relation to the outer surface of the cutter 22 and FIG. 13 shows the notch being curved.

The method of use and operation of the above described embodiment of the present invention will now be described.

A cylindrical spool 24 is fixed to the propeller shaft 16 so that it rotates with the propeller shaft 16. The diameter of the spool 24 should be approximately the same as the outer diameter of the carrier 12.

The mounting portion 20 of each cutter 22 is mounted to a carrier 12 by positioning the feet 72 on either end of the curved outer surface of the carrier 12 and aligning holes 40 with the threaded holes 50 in the carrier 12. Bolts are then screwed into position to securely attach each of the mounting portions 20 to the carrier 12. The projection 80 of the cutter 22 is inserted into the slot 74 and then positioned so that the base 83 of the cutter 22 is almost or just touching the spool 24.

The position of the cutter 22 is then adjusted so that it nearly or just makes contact with the circumferential surface of the spool 24. A bolt is then inserted into the elongate hole 48 and threaded hole 52 and tightened to secure the cutter 22 in position.

If any debris, such as rope, fishing line or other material becomes tangled with the propeller it will wrap around the spool 24 and continually tighten. As it becomes further entangled the debris will move towards the bearing where it will engage with the cutting edge 46 and be sliced away. The tighter the ravelling of the rope becomes, the more grip the spool has on the rope and the faster it is wound in and subsequently moves toward the blade. If the rope is then severed, any remaining rope within the reach of the cutter 22 will continue to be sliced. Any other rope remaining there will be relatively harmless. If any further rope becomes entangled it will then cause either the first rope or the new rope to again move towards the bladed portion whereupon it will again be cut away. Any other rope that becomes tangled with the carrier will be caught by cutting edges 76 and 76' of the carrier portion 20 or cutting edge 45 of the cutter 22.

If the vessel needs to reverse and the propeller shaft is rotated in the opposite direction, cutting edges 46', 76' and 45' performs the same function as cutting edges 46, 76 and 45, respectively.

The present invention is applicable to marine vessels with inboard and outboard motors. However, in many outboard motors, very little space is provided between the boss of the propeller and the portion of the leg of the outboard motor often called the torpedo. It is not desirable to provide a long propeller shaft to space the propeller from the boss to fit a spool over which the blade can skim. The below described embodiment of the present invention may be more suitable depending on the configuration of the propeller assembly and particularly in the case of outboard motors.

Referring to FIG. 14A, a cutting apparatus 100 of the present invention suitable for outboard motors, is shown. The apparatus 100 includes spool 112 fixed to propeller 116 to rotate with the propeller. Cutter 114 is mounted on a leg 120 of an outboard motor. The term "leg" is used to mean the portion of an outboard motor extending between the engine and the propeller. The leg 120 includes a bulging portion 118 often referred to as the torpedo. The torpedo 118 houses a bearing (not shown) equivalent to bearing 14 in the previous embodiment. In this case the objective is to prevent debris from entering the torpedo 118 by cutting it away.

The cutter 114 is positioned to provide a cutting edge 132 under which a surface of the spool 112 rotates. The under side of the cutter 114 is situated very close to the surface of the spool 112. The head of the cutter may be moveable with respect to its mounting means. In this case, upon installation or movement (adjustment) of the head, the head may be contacting the surface of the spool and with the first few revolutions of the propeller (and spool), the head may shave away a thin layer of the spool.

The boss of the propeller includes a step 125 before end surface 124. The rear 126 of the torpedo 118 and the surface 124 provide a gap between 128. Gap 128 may be so narrow that it is not practical to insert a spool therebetween, thus the spool 112 sits within the step 125. The spool 112 is therefore in the form of a ring. Because the blade is positioned very close to the surface of the spool 112, without the spool, the cutter runs the risk of damaging the boss of the propeller 116. If any vibrations or wear cause the cutter 114 to make contact with the spool 112, the spool 112 sacrificially protects the propeller 116 from damage from the cutter 114 whilst still acting to accumulate debris which is then cut away by the cutting edge 132.

Figure 14B:
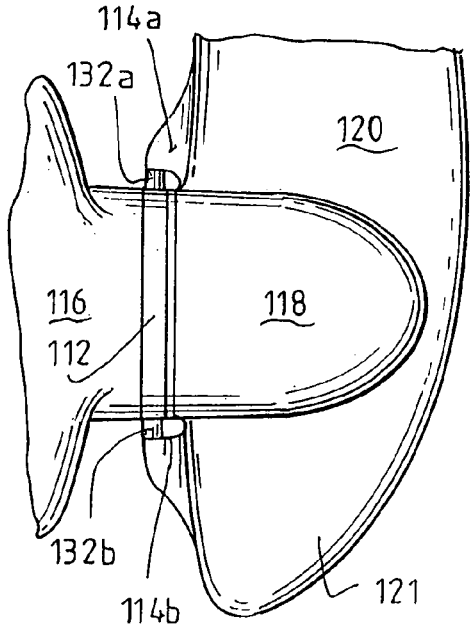
FIG. 14B is a side view of the cutting apparatus of FIG. 14A.

In FIG. 14B, it can be seen that the cutter 114 may be positioned either above the torpedo 118 (in the case of 14A), or below the torpedo 118 (in the case of 14B). In the case of cutter 14B, it is positioned on a skeg or fin 121 of the leg 120. Cutter 114 includes a mounting means for fixing the cutter to the leg 120 in a manner that positions the cutting edge 32A or 32B over the spool 112. The mounting means may be integrally formed as part of the leg 120 of the outboard motor as shown in FIGS. 14A and 14B or it may be an after-market add-on.

In FIG. 15A, the spool 112' is of slightly different form. In this case, it is a disc with a flange that mates with the surface of the boss of the propeller. This version is shown in more detail in FIG. 19.

Referring to FIG. 16, in this instance cutter 114" is coupled to either side of the torpedo 118. In the diagram it is shown as an after-market add-on, although it may be integrally cast into the torpedo at manufacture.

In FIG. 14, three cutters are shown to cut debris that accumulates on the spool and the boss of the propeller.

Figure 18:
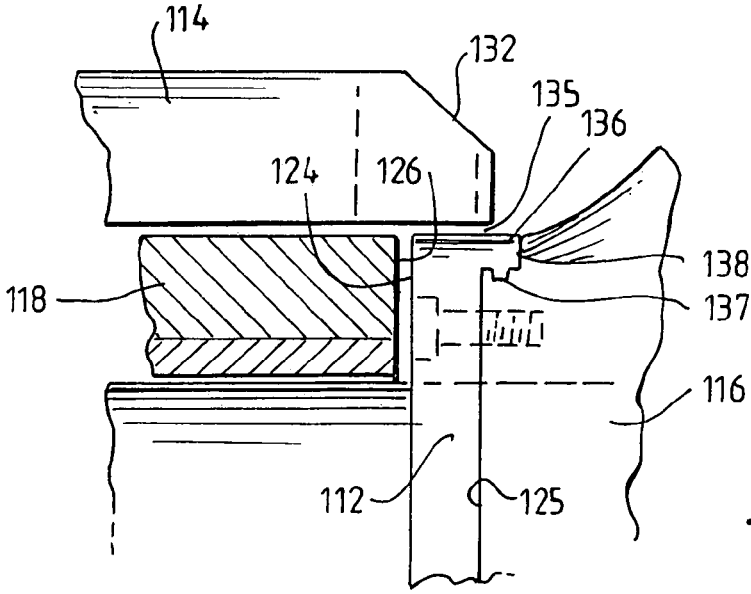
FIG. 18 is a cross-sectional side elevation of a cutting apparatus including a first embodiment of a spool according to the present invention.

Referring to FIG. 18, the spool 112 is in the form of a disc having a flange 136 nestled within a step 138 of the boss of a propeller 116. A surface of the disc abuts the surface of the boss of the propeller at 125. Another surface 124 of the spool 112 is spaced from surface 126 of the torpedo 118 in the case of an outboard motor, or bearing/carrier in the case of an inboard motor. Here the flange provides enough surface area 135 over which the head of cutter 114 can be positioned.

The disc 136 may be a single piece annulus affixed to the boss of the propeller 116, by for example, bolting it in place. Alternatively, it may be formed of a plurality of pieces that connect together to form the annulus shaped spool 112. The spool may be fixed to the propeller by an interlocking overlap between an inwardly directed flange of the spool and a recess or groove in the boss of the propeller, such as indicated by 137. A further alternative means of fixing the spool to the boss of the propeller is to use an adhesive. Yet another means for fixing the spool to the boss include press fit, shrink fit, screwing or bolting. Combinations of the above methods or other means of fixing may also be used.

Figure 19:
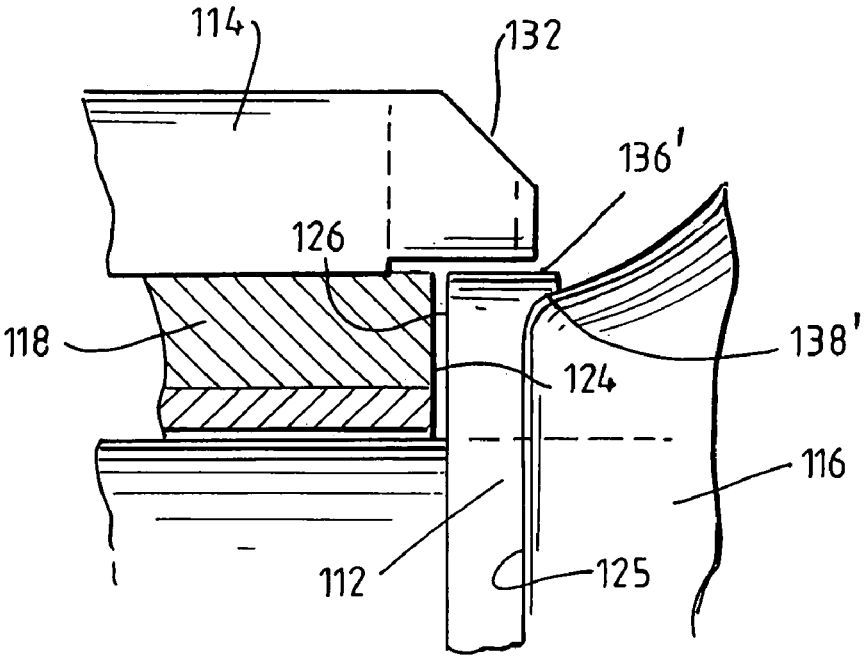
FIG. 19 is a side elevation of an alternative embodiment of a spool in accordance with the present invention.

In FIG. 19, the boss of the propeller has a rounded curve 138' rather than a pronounced step. In this case, the flange 136' is contoured to sit on the surface 125–138' of the boss of the propeller 116.

In FIG. 20, the spool 112 is in the form of a ring located within a step 138 on the boss of the propeller. In this instance the gap between the surface 126 of the torpedo and surface 125 of the boss of the propeller is so small that extending the spool into this gap is impractical. Nevertheless, the spool still performs the purpose of allowing debris to be wound around it (and the remainder of the propeller) and provides a protective surface between the cutter 114 and the propeller 116, with the spool 112 being worn or damaged in preference to the propeller or the cutter.

In this example the cutting edge 132 of the cutter 114 is sloped at an acute angle to the surface 135. This can provide an advantage by directing debris towards the spool so that it is wrapped tight and accumulates, thereby forcing it onto the cutting surface 132 and is then cut away by the cutting surface 132 of the cutter 114.

Referring to FIG. 21, the method of operation of this set of embodiments of the present invention is similar to the embodiments described above, however this set of embodiments provides certain advantages. Here it can be seen that the distance between the torpedo/bearing/carrier and the propeller 116 is considerably less. This is typical of an outboard motor but may also be applicable to an inboard motor. In this case, the spool 112 performs the function of allowing the debris, in this case rope 140, to accumulate thereon and on the boss of the propeller, and also provides a protective layer between the blade 114 and the boss of the propeller.

The skilled addressee will appreciate that the present invention has the advantage of keeping tangled debris including rope and long fishing line away from the bearing/torpedo. The more rope that becomes tangled the faster it will move towards the cutting edge whereupon it will be cut away.

The preferred embodiment of the invention has an adjustable bladed portion that can be adapted to fix to a variety of sizes of a spool, the spool may be a centrifugal pump for pumping lubricating fluid through the bearing. The mounting portion is able to be mounted to a variety of shapes of carrier.

Modifications and variations can be made to the present invention without departing from the basic inventive concept. Such modifications include:

(i) The number of cutters that may be mounted to a carrier;

(ii) The spool need not be a centrifugal pump as described in the preferred embodiment;

(iii) The angle of the cutting edges need not be as shown in the preferred embodiments; and (iv) Providing a removable cutting edge in the form of a blade tip so that if the cutting edge becomes blunt it can be replaced.

Such modifications and variations are deemed to be within in the scope of present invention, the nature of which is to be determined from the foregoing description.

The claims defining the invention are as follows:

1. A cutting apparatus for cutting debris from a propeller comprising:

a spool means fixed to a propeller shaft or the propeller so as to rotate with the propeller shaft and the propeller, wherein the spool means comprises a plurality of pieces that together form an annulus shaped spool, and the spool means further includes first and second longitudinal ends and is configured to receive windings of debris that accumulate on an outer surface of the spool means toward the first longitudinal end as the propeller shaft rotates in use, wherein the outer surface of the spool means is circular in a cross section perpendicular to the axis of rotation of the spool means; and a cutter securable proximate the first longitudinal end of the spool means and oriented to cut debris that accumulates on the outer surface of the spool means, wherein the cutter is arranged to be continuously closely positioned to the spool means so that debris is not readily able to enter a space between the cutter and the outer surface of the spool means.

2. A cutting apparatus for cutting debris from a propeller comprising:

a spool means fixed to a propeller shaft or the propeller so as to rotate with the propeller shaft and the propeller, wherein the spool means includes first and second longitudinal ends and is configured to receive windings of debris that accumulate on an outer surface of the spool means toward the first longitudinal end as the propeller shaft rotates in use, wherein the outer surface of the spool means is circular in a cross section perpendicular to the axis of rotation of the spool means; and a cutter securable proximate the first longitudinal end of the spool means and oriented to cut debris that accumulates on the outer surface of the spool means;

wherein the spool means comprises a relatively soft material that wears in preference to the cutter.

3. A cutting apparatus for cutting debris from a propeller comprising:

a spool means fixed to a propeller shaft or the propeller so as to rotate with the propeller shaft and the propeller, wherein the spool means includes first and second longitudinal ends and is configured to receive windings of debris that accumulate on an outer surface of the spool means toward the first longitudinal end as the propeller shaft rotates in use, wherein the outer surface of the spool means is circular in a cross section perpendicular to the axis of rotation of the spool means; and a cutter securable proximate the first longitudinal end of the spool means and oriented to cut debris that accumulates on the outer surface of the spool means;

wherein a cutting edge of the cutter is positioned radially in relation to the spool means such that the cutter overlaps a liquid outlet of the spool means.

4. A cutting apparatus according to claim 3, wherein the spool means includes a centrifugal pump.

5. A cutting apparatus for cutting debris from a propeller comprising:

a spool means comprising a circular liner ring circumferentially mounted on a circumferential surface of a boss of the propeller so as to rotate with the propeller shaft and the propeller, wherein the circular liner ring includes first and second longitudinal ends and is configured to receive windings of debris that accumulate on an outer surface of the circular liner ring toward the first longitudinal end as the propeller shaft rotates in use, and wherein the outer surface of the circular liner ring is circular in a cross section perpendicular to the axis of rotation of the spool means; and a cutter securable proximate the first longitudinal end of the circular liner ring and oriented to cut debris that accumulates on the outer surface of the circular liner ring.

6. A cutting apparatus for cutting debris from a propeller comprising:

a spool means fixed to a propeller shaft or the propeller so as to rotate with the propeller shaft and the propeller, wherein the spool means includes first and second longitudinal ends and is configured to receive windings of debris that accumulate on an outer surface of the spool means toward the first longitudinal end as the propeller shaft rotates in use, wherein the outer surface of the spool means is circular in a cross section perpendicular to the axis of rotation of the spool means; and a cutter securable proximate the first longitudinal end of the spool means and oriented to cut debris that accumulates on the outer surface of the spool means;

wherein the spool means comprises a sacrificially wearable element positioned between the cutter and the propeller.

7. A cutting apparatus for cutting debris from a propeller comprising:

a spool means fixed to a propeller shaft or the propeller so as to rotate with the propeller shaft and the propeller, wherein the spool means includes first and second longitudinal ends and is configured to receive windings of debris that accumulate on an outer surface of the spool means toward the first longitudinal end as the propeller shaft rotates in use, wherein the outer surface of the spool means is circular in a cross section perpendicular to the axis of rotation of the spool means; and a cutter securable proximate the first longitudinal end of the spool means and oriented to cut debris that accumulates on the outer surface of the spool means;

wherein the spool means comprises a circular flange for fitting within a circumferential recess or groove around a boss of the propeller.

8. A cutting apparatus according to claim 7, wherein the recess or groove is formed at a shoulder of the boss of the propeller.

9. A cutting apparatus according to claim 7, wherein the circular flange is inwardly directed and the spool means is fixed to the propeller by an interlocking overlap between the circular inwardly directed flange of the spool means and the circumferential recess or groove of the propeller.

10. A cutting apparatus for cutting debris from a propeller comprising:

a spool means fixed to a propeller shaft or the propeller so as to rotate with the propeller shaft and the propeller, wherein the spool means includes first and second longitudinal ends and is configured to receive windings of debris that accumulate on an outer surface of the spool means toward the first longitudinal end as the propeller shaft rotates in use, wherein the outer surface of the spool means is circular in a cross section perpendicular to the axis of rotation of the spool means; and a cutter securable proximate the first longitudinal end of the spool means and oriented to cut debris that accumulates on the outer surface of the spool means;

wherein the spool means consists of a disc located between a boss of the propeller and a bearing holding the propeller shaft.

11. A cutting apparatus according to claim 10, wherein the disc comprises a recess arranged to receive a portion of the boss of the propeller such that the disc overlaps with the portion of the boss of the propeller.

12. A cutting apparatus according to claim 10, wherein the disc is of a thickness sufficient for a cutting head of the cutter to be completely radially disposed over the disc.

* * * * *